US005986392A

United States Patent [19]

Kim

[11] Patent Number: 5,986,392

[45] Date of Patent: Nov. 16, 1999

[54] SHADOW MASK FOR A COLOR CATHODE RAY TUBE

[75] Inventor: Sang-Mun Kim, Kyongsangbuk-do, Rep. of Korea

[73] Assignee: LG Electronics Inc., Seoul, Rep. of Korea

[21] Appl. No.: 08/957,629

[22] Filed: Oct. 24, 1997

[30] Foreign Application Priority Data

Oct. 25, 1996 [KR] Rep. of Korea ..... 96-48311

[51] Int. Cl.[6] ..... H01J 29/07

[52] U.S. Cl. ..... 313/402

[58] Field of Search ..... 313/402, 407, 313/408

[56] References Cited

U.S. PATENT DOCUMENTS 2,890,362 6/1959 Francken ..... 313/402

4,612,061 9/1986 Suzuki et al. ..... 313/402 X 4,698,545 10/1987 Inaba et al. ..... 313/402

5,752,755 5/1998 Rho et al. ..... 313/402

5,841,223 11/1998 Muramatsu et al. ..... 313/402

*Primary Examiner*—Ashok Patel

*Attorney, Agent, or Firm*—Finnegan, Henderson, Farabow, Garrett & Dunner, L.L.P.

[57] ABSTRACT

A shadow mask for a color CRT, by which the electron beams can be focussed to the corresponding fluorescent body coated on the inner surface of a panel, includes: a first layer positioned toward a fluorescent body, and having thermal expansion coefficient between $5.0\times10^{-6}/°$ C. and $13\times10^{-6}/°$ C., and a second layer oriented toward electron guns, and having thermal expansion coefficient of below $5.0\times10^{-6}/°$ C. The second layer is 0.001 to 0.5 times as thick as the first layer.

19 Claims, 2 Drawing Sheets

SHADOW MASK FOR A COLOR CATHODE RAY TUBE

BACKGROUND OF THE INVENTION

A. Field of the Invention

The present invention relates to a shadow mask for a color cathode ray tube (CRT).

B. Discussion of Related Art

A typical color CRT is illustrated in FIG. 1. On the inner surface of a panel 1 is coated with fluorescent coatings 4 and joined, by applying glass fused at about 450° C., to a funnel 2 whose inner surface is coated with conductive graphite. In a mark section 7 of the funnel 2 is positioned electron guns 3 that generate and direct three separate electron beams 10. A frame 6 supports a shadow mask 5 functioning as three electrodes to perform the sorting out of the three color beams in the panel 1, and a deflection yoke 8 is placed around the neck of the funnel 2 to produce a magnetic field for deflecting the electron beams 10.

When image signals are fed into the color CRT as described above, the cathodes of the electron guns 3 emit the thermal electrons, which are accelerated and converged toward the panel 1 by voltage applied to the electrodes of the electron guns 3.

Each electron is directed by the magnetic field of a magnet 9 settled in the mask part of the panel 1 and brought to focus on the front surface of the panel 1 by the deflection yoke 8. The sorting out of the electron beams 10 is performed by the shadow mask 5 combined to the internal frame of the panel 1. The electrons from the three guns 3 pass through each slot 11 of the shadow mask 5, and thus sorted electron beams strike the respective dots on the fluorescent coatings 4 on the inner surface of the panel 1.

As the electron beams projected from the electron guns 3 are deflected by the deflection yoke 8 and pass through the slots of the shadow mask 5 to make the fluorescent coatings 4 emit lights, the shadow mask 5 permits the fluorescent coatings 4 to produce each of red, green and blue lights from the three electron beams 10 that are controlled by the three color signals.

Only about 20% of electrons can pass through the slots of the shadow mask in a prior art color CRT, and the rest of them hit the shadow mask, causing a "doming effect" by which the shadow mask is heated and swelled up. The doming effect causes a mislanding effect where the electron beams cannot impinge on the intended color dots of the screen, and by this way produces a color blotting and a deterioration in luminance and chrominance. The cause of this mislanding effect may be found in the fact that the frame and spring, functioning as a support of the shadow mask and its peripherals, are made of a metallic material that has a high thermal expansion coefficient, and particularly that the shadow mask of pure iron has such a high expansion coefficient to produce a rapid thermal deformation.

SUMMARY OF THE INVENTION

Accordingly, the present invention is directed to a shadow mask for a color CRT that substantially obviates one or more of the problems due to limitations and disadvantages of the related art.

An object of the present invention is to provide a shadow mask that is designed to prevent the doming effect and the color blotting by reducing a thermal deformation, thus reducing a deterioration in the quality of image.

Additional objects and advantages of the invention will be set forth in the description which follows, and in part will be apparent from the description, or may be learned by practice of the invention. The objects and advantages of the invention will be realized and attained by the structure particularly pointed out in the written description and claims hereof as well as the appended drawings.

To achieve these and other advantages and in accordance with the purpose of the present invention, as embodied and broadly described herein, the invention provides a dual-layered shadow mask for a color cathode ray tube (CRT), which comprises a first layer having a first thermal expansion coefficient and a second layer having a second thermal expansion coefficient. The first coefficient is greater than the second coefficient.

In another aspect, the invention, as embodied herein, provides a process of manufacturing a dual-layered shadow mask for a color cathode ray tube (CRT), which comprises forming a first layer having a first thermal expansion coefficient and forming a second layer having a second thermal expansion coefficient over the first layer. The first coefficient is greater than the second coefficient.

It is to be understood that both the foregoing general description and the following detailed description are exemplary and explanatory and are intended to provide further explanation of the invention as claimed.

The accompanying drawings, which are included to provide a further understanding of the invention and are incorporated in and constitute a part of this specification, illustrate embodiments of the invention and together with the description serve to explain the principles of the invention:

BRIEF DESCRIPTION OF THE ATTACHED DRAWINGS

DETAILED DESCRIPTION OF PREFERRED EMBODIMENT

Reference will now be made in detail to the preferred embodiments of the present invention, examples of which are illustrated in the accompanying drawings.

Figure 1:
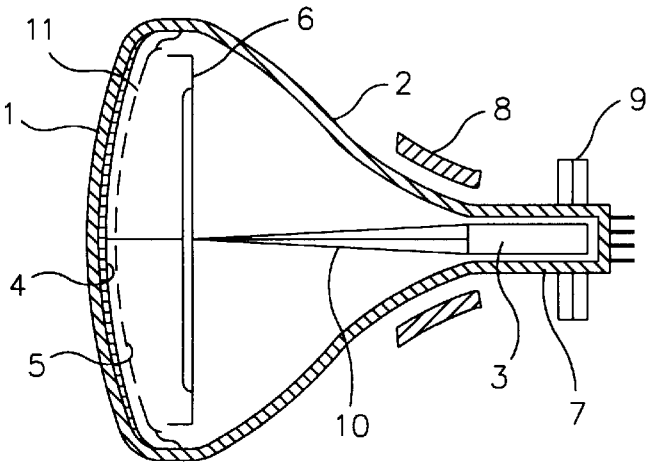
Fig. 1 (Prior Art)
FIG. 1 illustrates a general color CRT.
Figure 2:
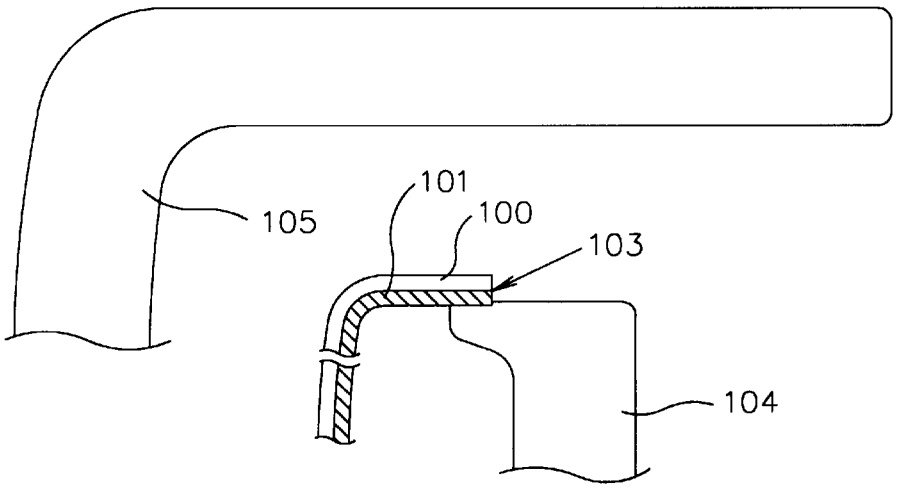
FIG. 2 illustrates a color CRT in accordance with an embodiment of the present invention.

FIG. 2 illustrates a shadow mask in accordance with a preferred embodiment of the present invention. As shown in FIG. 2, the shadow mask 103 is of a dual-layered structure including a first layer 100 which is made of a material whose thermal expansion coefficient is between $5.0\times10^{-6}$ $deg^{-1}$ and $13\times10^{-6}$ $deg^{-1}$, range of thermal expansion coefficient, consists of an alloy having the thermal expansion coefficient of $12\times10^{-6}$ $deg^{-1}$ such as pure iron, an alloy of iron and nickel, a Mo—Ti—Zr alloy, a Ni—Ti alloy, a Pt—Li alloy, or the like. The second layer 101, whose material is below $5.0\times10^{-6}$ $deg^{-1}$ in thermal expansion coefficient, uses an INVAR type alloy such as an INVAR composed of pure iron of 64% and nickel of 36%, and a SUPER INBER composed of pure iron of 63%, nickel of 32% and cobalt of 5%, an Fe—Co—Cr alloy composed of iron of 36 to 35%, cobalt of 54 to 56% and chrome of 5 to 7%, an ELINBAR type alloy composed of iron of 52%, nickel of 36% and chrome of 12%, and a platinate alloy. The first and second layers are combined to each other by means of a vacuum deposition method.

The vacuum deposition is performed under the vacuum between $10^{-2}$ and $10^{-10}$ torr, with an insignificant thermal deformation, by using a material of a low thermal expansion coefficient for target elements, while the substrate is made of a material with a high thermal expansion coefficient. Deposition of this type preferably employs a sputtering or thermal spray method, instead of a chemical deposition such as CVD that is difficult to use because of the selectivity of the material to be deposited. Following the deposition, the layer is etched for use as a shadow mask.

The layer deposited is preferably 1/1000 to 5/10 times as thick as the substrate material. If less than 1/1000 times, the base material having a property of high thermal expansion will be too thick as compared to the thin layer to reduce the thermal deformation of the shadow mask. A thick layer which is more than 5/10 times as thick as the substrate material will make the layer deposition useless.

As shown in FIG. 2, the shadow mask 103 is positioned so that the layer 101 of a low thermal expansion coefficient is oriented toward the electron guns and the layer 100 with a high thermal expansion coefficient looks toward the panel.

The layer 101 having a low thermal expansion coefficient looks toward the electron guns so as to prevent the shadow mask's thermal expansion that occurs due to the collisions of the electron beams projected from the electron guns with the shadow mask.

The present invention of the above construction is designed to provide a shadow mask 103 of combined dual layers in order to reduce the deterioration in chromaticity and luminance of images, by preventing the doming effect that is caused by the electron beams of about 80% striking the shadow mask. As described above, the layer of a high thermal expansion coefficient is opposite to the fluorescent body but the layer with a low thermal expansion coefficient is oriented toward the electron beams of 80% so that the thermal deformation of the shadow mask can be avoided.

Figure 4:
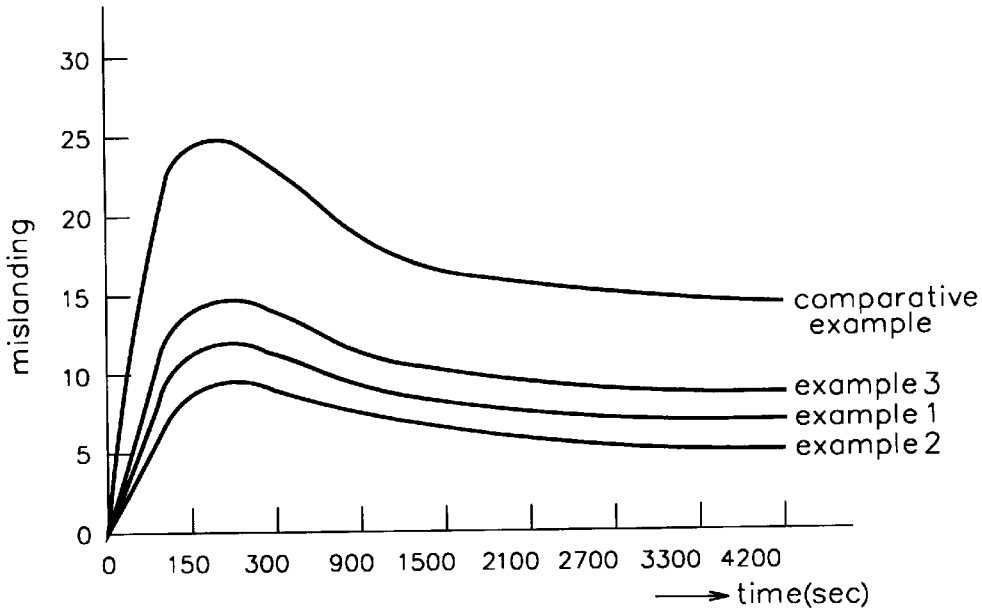
FIG. 4 shows the doming characteristics of the comparative example and the embodiments of the present invention.

FIG. 4 shows the doming characteristics over time at the point (106, 78) on the surface of the panel face of a 17" color CRT, which is produced by fabricating the dual-layered shadow mask substrate, after a test of the embodiment and the comparative example under the same condition as listed in table 1, and performing an etching with a 60% $FeCl_2$ solution or 30% $FeCl_3$ solution.

Figure 3:
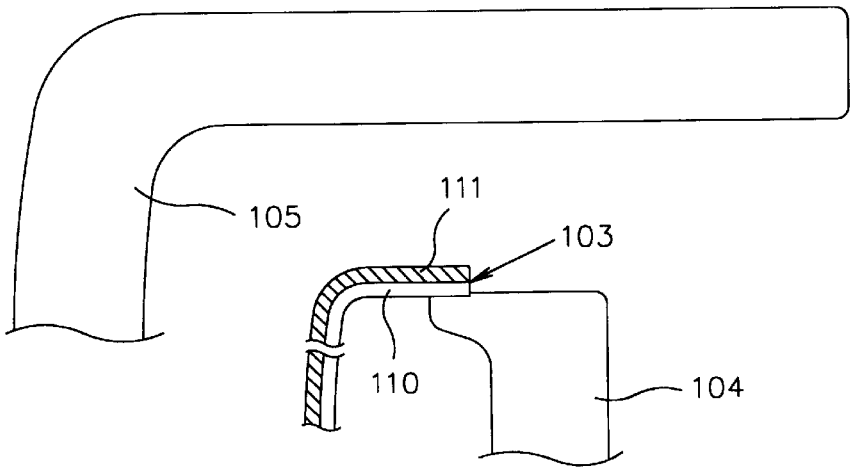
FIG. 3 illustrates a color CRT in accordance with another embodiment of the present invention.

FIG. 3 illustrates a shadow mask in accordance with another preferred embodiment of the present invention. The shadow mask is so positioned that the layer 110 having a high thermal expansion coefficient is oriented toward the electron guns and the layer 111 with a low thermal expansion coefficient looks toward the panel.

As described above, the shadow mask of the present invention can prevent a thermal deformation caused by a landing of the electron beams, thus improving the quality of image even when the thickness of the shadow mask is reduced.

It will be apparent to those skilled in the art that various modifications and variations can be made in a shadow mask for a color CRT according to the present invention without departing from the spirit or scope of the invention. Thus, it is intended that the present invention cover the modifications and variations of this invention provided they come within the scope of the appended claims and their equivalents.

What is claimed is:

1. A dual-layered shadow mask for a color cathode ray tube (CRT), comprising:

a first layer having a first thermal expansion coefficient and a second layer over the first layer having a second thermal expansion coefficient less than said first coefficient.

2. The shadow mask as defined in claim 1, wherein said first coefficient is between $5.0\times10^{-6}$/° C. and $13\times10^{-6}$/° C.

3. The shadow mask as defined in claim 1, wherein said second coefficient is less than $5.0\times10^{-6}$/° C.

4. The shadow mask as defined in claim 1, wherein said first coefficient is between $5.0\times10^{-6}$/° C. and $13\times10^{-6}$/° C. and said second coefficient is less than $5.0\times10^{-6}$/° C.

5. The shadow mask as defined in claim 1, wherein the second layer is 0.001 to 0.5 times as thick as the first layer.

6. The shadow mask as defined in claim 2, wherein the first layer includes pure iron.

7. The shadow mask as defined in claim 2, wherein the first layer includes iron and nickel.

8. The shadow mask as defined in claim 2, wherein the first layer includes a Mo—Ti—Zr alloy.

9. The shadow mask as defined in claim 2, wherein the first layer includes a Ni—Ti alloy.

10. The shadow mask as defined in claim 2, wherein the first layer includes a Pt—Li alloy.

TABLE 1

Test Conditions for the Embodiments of the Present Invention and Comparative Example.

| | | MATERIAL | THIN FILM FORMATION | THICKNESS OF SECOND LAYER |
|---|---|---|---|---|
| EXAMPLE 1 | SECOND LAYER | Fe(36%)—Ni ALLOY | BY SPUTTERING UNDER VACUUM OF $10^{-6}$ Torr | 100 μm |
| | FIRST LAYER | AK STEEL | | |
| EXAMPLE 2 | SECOND LAYER | Fe(63%)—Ni(32%)—Co(5%) ALLOY | | 150 μm |
| | FIRST LAYER | AK STEEL | | |
| EXAMPLE 3 | SECOND LAYER | Fe(36%)—Co(54%)—Cr(10%) ALLOY | | 200 μm |
| | FIRST LAYER | AK STEEL | | |
| COMPARATIVE EXAMPLE | SINGLE LAYER | AK STEEL | | |

*AK Steel: pure iron removed of aluminum

11. The shadow mask as defined in claim 3, wherein the second layer includes pure iron and nickel.

12. The shadow mask as defined in claim 3, wherein the second layer includes pure iron of about 64% and nickel of about 36%.

13. The shadow mask as defined in claim 3, wherein the second layer includes pure iron, nickel and cobalt.

14. The shadow mask as defined in claim 3, wherein the second layer includes pure iron of about 63%, nickel of about 32% and cobalt of about 5%.

15. The shadow mask as defined in claim 3, wherein the second layer includes iron, cobalt and chrome.

16. The shadow mask as defined in claim 3, wherein the second layer includes iron of about 35–36%, cobalt of about 54–56% and chrome of 5–7%.

17. The shadow mask as defined in claim 3, wherein the second layer includes iron, nickel and chrome.

18. The shadow mask as defined in claim 3, wherein the second layer includes iron of about 52%, nickel of about 36% and chrome of about 12%.

19. The shadow mask as defined in claim 3, wherein the second layer includes a platinate alloy.

* * * * *